US009021766B1

(12) United States Patent
Hayes

(10) Patent No.: US 9,021,766 B1
(45) Date of Patent: May 5, 2015

(54) METHOD OF FLOOD REPAIR USING A BASEBOARD

(71) Applicant: John W. Hayes, St. Augustine, FL (US)

(72) Inventor: John W. Hayes, St. Augustine, FL (US)

( * ) Notice: Subject to any disclaimer, the term of this patent is extended or adjusted under 35 U.S.C. 154(b) by 0 days.

(21) Appl. No.: 14/062,869

(22) Filed: Oct. 24, 2013

Related U.S. Application Data

(62) Division of application No. 13/677,788, filed on Nov. 15, 2012, now abandoned.

(51) Int. Cl.
*E04B 1/66* (2006.01)
*E04G 23/02* (2006.01)

(52) U.S. Cl.
CPC ..... *E04G 23/0203* (2013.01)

(58) Field of Classification Search
USPC ..... 52/287.1, 514, 459, 220.3, 220.8, 272, 52/274, 716.1, 286, 293.3, 302.1, 716.8, 52/718.01, 745.2
See application file for complete search history.

(56) References Cited

U.S. PATENT DOCUMENTS 3,481,090 A 12/1969 Lizee
3,861,103 A 1/1975 Rasmussen
3,956,861 A 5/1976 Rasmussen
4,620,407 A * 11/1986 Schmid ..... 52/745.09
5,925,204 A * 7/1999 Hoffmann, Sr. ..... 156/98
6,504,098 B2 1/2003 Seamans
8,297,015 B2 10/2012 Martin
2007/0163191 A1 7/2007 Berry
2009/0211021 A1 * 8/2009 Gabriele ..... 4/678
2011/0219714 A1 9/2011 Martin

FOREIGN PATENT DOCUMENTS

JP 2000-220285 A 8/2000

* cited by examiner

*Primary Examiner* — Jeanette E Chapman
(74) *Attorney, Agent, or Firm* — Walker, McKenzie & Walker, P.C.

(57) ABSTRACT

A baseboard for repair of a flood-damaged building and for construction of buildings located in areas prone to flooding, and a method of use of such a baseboard in repairing a flood-damaged building or in construction of buildings located in areas prone to flooding. The baseboard has one or more rearwardly-extending standoffs. A rear surface portion of the baseboard defines a plane, and a distal surface of the standoff(s) is spaced rearwardly from the plane by the standard thickness of wallboard mounted to studs on the building's wall. The bottom edge of the wallboard is above the "high-water" line, and the rear surface portion of the baseboard extends above the bottom edge of the wallboard and rests adjacent the outer surface of the wallboard with the distal surface of the standoff(s) supported by and resting adjacent the studs below the bottom edge of the wallboard.

2 Claims, 1 Drawing Sheet

METHOD OF FLOOD REPAIR USING A BASEBOARD

CROSS REFERENCE TO RELATED APPLICATIONS

This application is a division, and claims priority benefit, of pending U.S. patent application Ser. No. 13/677,788 (filed Nov. 15, 2012) entitled Baseboard for Flood Repair and Method of Installation, fully included by reference herein.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to building construction and repair, and, in particular, to repair of buildings damaged by flooding.

2. Information Disclosure Statement

Buildings, and especially residential buildings, are often damaged by flooding during a storm. When this happens, the time and cost to repair the building and make it habitable can be substantial.

The standard prior art repair procedure used, regardless of whether the flooding "high water" mark is one inch (2.54 cm.) or 47 inches (1.2 m.) above the floor level, is to remove the existing wall's baseboard, then to cuttingly remove the existing (damaged) wall covering, such as drywall plaster or gypsum board (such as that sold under the trademark SHEETROCK by United States Gypsum Company), from the wall's studs at a height of four feet (1.2 m.) above the floor, then remove any flood-damaged insulation from within the wall, air dry the flooded wall space using drying blowers, then replace the wall covering with new drywall plaster or gypsum board, tape and plaster ("mud") the seams, sand the taped seams, replace the baseboard, and then paint the entire repaired wall and baseboard.

Those skilled in the art will recognize that most non-disaster flooding is due to basement flooding or room flooding caused by flash floods. Even if the "high water" mark from flooding is only six inches (15 cm.) or so above the floor, as is the case with most flooding, the drywall plaster or gypsum board wall covering will become waterlogged and damaged by the flooding, and wicking of the water up the gypsum board may even cause water damage above the high water flooding mark. Additionally, because of issues of mold and contamination inside the walls, and absorption of water by insulation within the walls, it is necessary to tear out or remove the wall covering so that damaged insulation can be removed and so that drying blowers can be used to dry the interior of the walls to prevent the growth of mold within the walls.

Again, such repair and reconstruction is time consuming and expensive, and delays the time until the damaged building can become habitable. For buildings located in a flood plain or in costal regions, such repair and reconstruction can happen year after year.

It is therefore desirable to have an improved construction material for use in such repair and reconstruction situations after flooding, and which facilitates the repair and reconstruction process at lesser cost and labor expenditure than heretofore possible. It is further desirable to provide an improved construction material for use in new building construction prior to flooding that will lessen the repair time if flooding should occur in the future.

BRIEF SUMMARY OF THE INVENTION

The present invention is an improved baseboard for use in repair of a flood-damaged building and for use in new construction of buildings located in areas that are prone to flooding. The present invention further includes a method of use of such an improved baseboard in repairing a flood-damaged building or in new construction of buildings located in areas that are prone to flooding. The baseboard has at least one rearwardly-extending standoff, and preferably a plurality of such rearwardly-extending standoffs. A rear surface portion of the baseboard defines a plane, and a distal surface of the standoff(s) is spaced rearwardly from the plane by the standard thickness of wallboard mounted to studs on the building's wall. The bottom edge of the wallboard is above the actual or expected "high-water" line, typically at least six inches (15.2 cm.) and preferably about seven inches (17.8 cm.) above the floor, and the rear surface portion of the baseboard extends above the bottom edge of the wallboard and rests adjacent the outer surface of the wallboard with the distal surface of the standoff(s) being supported by and resting adjacent at least one of the studs below the bottom edge of the wallboard.

The method of repairing a flood-damaged interior wall of a building involves removing any existing baseboard from the wall and cutting off and removing the lower (flood damaged) portion of wallboard on the wall, such that the bottom edge of the remaining undamaged wallboard is spaced above the floor of the building higher than the certain actual "high water" line, typically at least six inches (15.2 cm.) and preferably about seven inches (17.8 cm.) above the floor. The flooded space within the wall is then air dried using drying blowers. A baseboard of the present invention is then provided and installed on the wall, with the rear surface portion of the baseboard being supported by and resting adjacent the outer surface of the wallboard and with the distal surface of the standoff(s) being supported by and resting adjacent at least one of the studs below the bottom edge of the wallboard. The repaired baseboard and wall are then painted.

The method of construction of a baseboard and wall combination of the present invention involves providing wallboard mounted to studs on a wall of a building, wherein the bottom edge of the wallboard is spaced above a floor of the building higher than a certain actual/expected "high water" line, typically at least six inches (15.2 cm.) and preferably about seven inches (17.8 cm.) above the floor. A baseboard of the present invention is provided and installed on the wall, with the rear surface portion of the baseboard supported by and resting adjacent the outer surface of the wallboard and with the distal surface of the standoff(s) supported by and resting adjacent at least one of the studs below the bottom edge of the wallboard. The wall and baseboard are then painted. If the improved baseboard and wall later become flooded, the baseboard is simply removed, the space behind the baseboard and within the wall is air dried using drying blowers, and the baseboard is then replaced without having to cut the wallboard, and the repaired wall and baseboard are then painted.

It is an object of the present invention to provide an improved baseboard and method of installation and use that permits repair of flooded buildings in less time and at lower cost than heretofore possible.

DETAILED DESCRIPTION OF THE INVENTION

Figure 1:
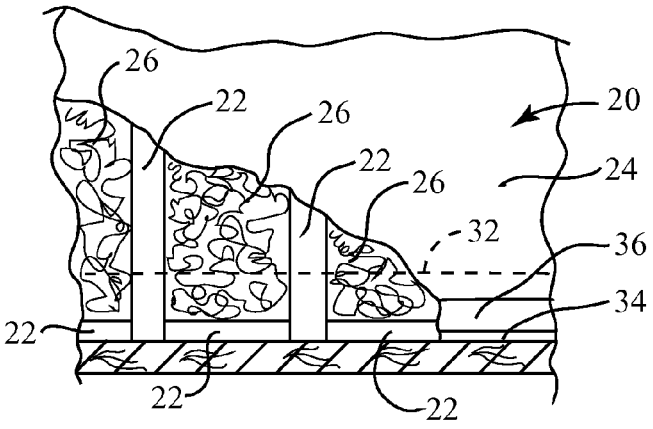
Fig. 1 (Prior Art)
FIG. 1 is an elevational view of a prior art flood-damaged wall of a building, with portions of wallboard removed to show hidden details.

Referring to FIG. 1, an interior wall 20 of a building is shown. Wall 20 has a plurality of well-known studs 22, typically wood or metal, forming the interior structure of wall 20. Wall 20 has a substantially rigid wallboard 24 mounted to studs 22 using well-known anchors such as nails or screws, and may have insulation 26 between the studs 22 and behind the wallboard 24 within the wall 20. It shall be understood that the term "wallboard", as used herein, is defined to be a structural boarding of any of various materials, such as, for example, wood pulp, gypsum, plastic, plasterboard, paneling, etc., made in large rigid sheets and used for sheathing interior walls. Wallboard 24 has a certain standard thickness 28, typically 0.5 inch (1.27 cm.) or 0.75 inch (1.9 cm.), such that the outer surface 30 of wallboard 24 is spaced from studs 22 by the standard thickness 28 of wallboard 24. Dotted line 32 shows an expected or actual flood damage height above a floor 34 of the building, typically at least six inches (15.2 cm.) or about seven inches (17.8 cm.) above the floor, and the prior art wall 20 may be provided with a pre-existing baseboard 36 against the wall 20 at floor 34.

Figure 2:
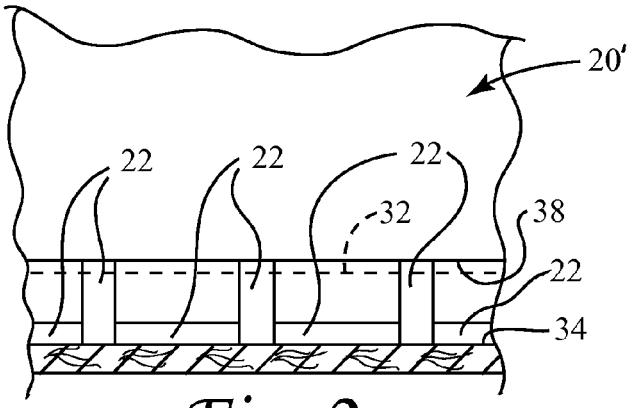
FIG. 2 is an elevational view of a wall of a building, prepared for installation of the baseboard of the present invention.

FIG. 2 shows a wall 20' after preparation for installation of the improved baseboard of the present invention. For use with a previously-damaged building wall, the pre-existing baseboard is removed and the bottom edge 38 of the wallboard is cut off above the "high water" line of the actual flood damage height 32, typically at least six inches (15.2 cm.) and preferably about seven inches (17.8 cm.) above the floor. Any waterlogged insulation, if present, is removed and air drying blowers, well known to those skilled in the art, may be used to dry out the interior of the wall so that mold and mildew do not develop.

Also as shown in FIG. 2, for use with new construction to enable easy repair by the method of the present invention, wallboard 24 is mounted to studs 22 with the bottom edge 38 of wallboard 24 being above a certain actual/expected flood damage height, typically at least six inches (15.2 cm.), and preferably about seven inches (17.8 cm.), above the floor 34, with wallboard 24 extending upwardly from its bottom edge 26.

Figure 3:
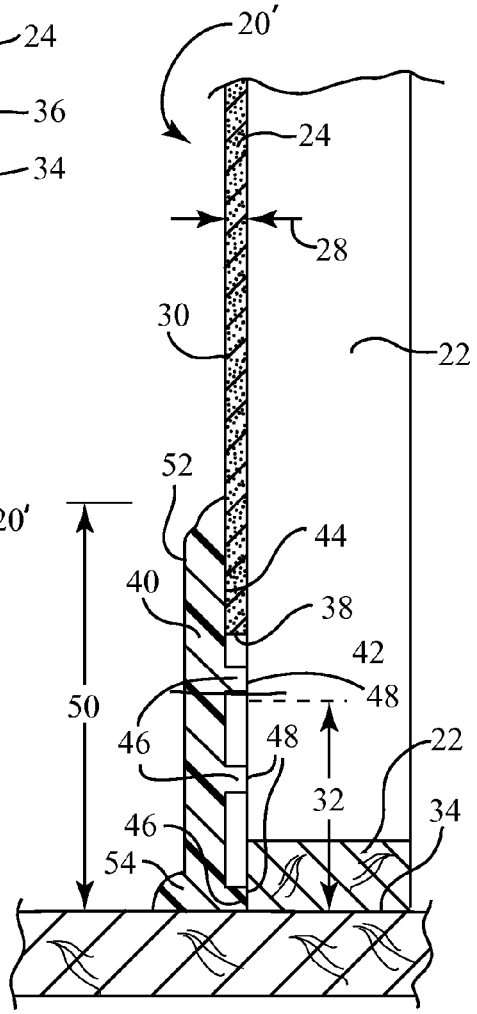
FIG. 3 is a side sectional view of a wall of a building, showing installation of the baseboard of the present invention.
Figure 4:
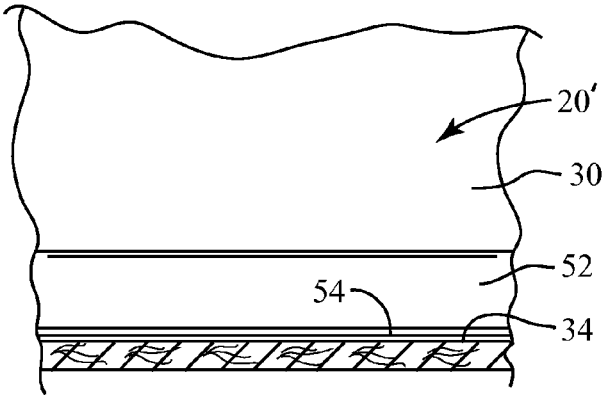
FIG. 4 is an elevational view of a wall of a building after installation of the baseboard of the present invention.

As seen best in FIG. 3, the improved baseboard 40 of the present invention has a rear surface portion 42 defining a plane 44 for resting adjacent the outer surface 30 of wallboard 24, and baseboard 40 has at least one rearwardly-extending standoff 46, and preferably a plurality of rearwardly-extending standoffs 46, with standoff 46 having a distal surface 48 spaced rearwardly from plane 44 by thickness 28 of wallboard 24. Baseboard 40 has a selected vertical dimension 50 somewhat greater than the certain actual/expected flood height damage, preferably about 2.0 inches (5.1 cm.) greater than the certain actual/expected flood damage height, for overlap with the bottom of wallboard 24. With such a structure, distal surface 42 is supported by and rests adjacent one or more studs 22 without intervening wallboard therebetween when rear surface portion 42 of baseboard 40 rests adjacent outer surface 30 of wallboard 24, thereby hiding the gap between the bottom edge 38 of wallboard 24 and the floor 34. If desired, without departing from the scope of the present invention, a layer of paper or plastic (not shown) may be provided between studs 22 and distal surface 48 of the standoff(s) 46. Baseboard 40 may have a generally flat outer face 52 for installation above a carpeted floor or may, if desired, have a quarter-round molding 54 provided at the bottom of outer face 50 of baseboard 40 when baseboard 40 is installed above an uncarpeted tile or hardwood floor 34. Baseboard 40 is preferably formed from extruded well-known cellular vinyl PVC (polyvinyl chloride) material so as to prevent rotting and to be resistant to mold and mildew.

The method of repairing a flood-damaged interior wall of a building involves removing any existing baseboard from the wall and cutting off and removing the lower (flood damaged) portion of wallboard on the wall, such that the bottom edge of the remaining undamaged wallboard is spaced above the floor of the building higher than the certain actual "high water" line, typically at least six inches (15.2 cm.) and preferably about seven inches (17.8 cm.) above the floor. The flooded space within the wall is then air dried using drying blowers. A baseboard of the present invention is then provided and installed on the wall, with the rear surface portion of the baseboard being supported by and resting adjacent the outer surface of the wallboard and with the distal surface of the standoff(s) being supported by and resting adjacent at least one of the studs below the bottom edge of the wallboard. The repaired baseboard and wall are then painted.

The method of construction of a baseboard and wall combination of the present invention involves providing wallboard mounted to studs on a wall of a building, wherein the bottom edge of the wallboard is spaced above a floor of the building higher than a certain actual/expected "high water" line, typically at least six inches (15.2 cm.) and preferably about seven inches (17.8 cm.) above the floor. A baseboard of the present invention is provided and installed on the wall, with the rear surface portion of the baseboard being supported by and resting adjacent the outer surface of the wallboard and with the distal surface of the standoff(s) being supported by and resting adjacent at least one of the studs below the bottom edge of the wallboard. The wall and baseboard are then painted. If the improved baseboard and wall later become flooded, the baseboard is simply removed, the space behind the baseboard and within the wall is air dried using drying blowers, and the baseboard is then replaced without having to cut the wallboard, and the repaired wall and baseboard are then painted.

Although the present invention has been described and illustrated with respect to a preferred embodiment and a preferred use therefor, it is not to be so limited since modifications and changes can be made therein which are within the full intended scope of the invention.

I claim:

1. A method of repairing a flood-damaged interior wall of a building, said method comprising the steps of:

(a) providing a flood-damaged interior wall of a building, said wall comprising a plurality of studs and said wall further comprising a flood-damaged wallboard mounted upon said studs, said wallboard having an outer surface and having a certain thickness and having a flood damage height above a floor of the building; then (b) cutting off a lower portion of said damaged wallboard of said flood-damaged interior wall to form a wallboard lower cut edge above said flood damage height;

(c) providing a baseboard, said baseboard having a rear surface portion defining a plane for resting adjacent said outer surface of said cut wallboard above said wallboard lower cut edge, said baseboard comprising at least one rearwardly-extending standoff having a distal surface spaced rearwardly from said plane by said certain thickness for resting adjacent at least one of said studs, said baseboard having a vertical dimension greater than the height of said wallboard lower cut edge above the floor; then (d) mounting said baseboard to said cut wallboard with said rear surface portion of said baseboard resting adjacent said outer surface of said cut wallboard and with said distal surface of said at least one standoff resting adjacent at least one of said studs.

2. The method as recited in claim 1, in which said baseboard has no transverse air ports extending through said baseboard and said rear surface portion thereof.

* * * * *